US010555630B2

(12) United States Patent
Green

(10) Patent No.: US 10,555,630 B2
(45) Date of Patent: Feb. 11, 2020

(54) CUTLERY LIFTING AND SEPARATING DEVICE WITH CONTAMINATION PREVENTION

(71) Applicant: Forward Thinking Concepts, Inc, Albuquerque, NM (US)

(72) Inventor: Rebekah Green, Los Angeles, CA (US)

( * ) Notice: Subject to any disclaimer, the term of this patent is extended or adjusted under 35 U.S.C. 154(b) by 0 days.

(21) Appl. No.: 16/032,007

(22) Filed: Jul. 10, 2018

(65) Prior Publication Data

US 2020/0015611 A1 Jan. 16, 2020

(51) Int. Cl.
*A47G 21/14* (2006.01)

(52) U.S. Cl.
CPC ..... *A47G 21/14* (2013.01)

(58) Field of Classification Search
CPC ..... A47G 21/14; A47G 29/087; A47B 77/14; A47F 13/08; A47F 2001/103; A47J 41/02; A47J 45/00; A47J 47/16
USPC ..... 211/70.7, 59.4; 248/37.3, 37.6; 206/553; D7/637–641; 30/296.1, 298.4
See application file for complete search history.

(56) References Cited

U.S. PATENT DOCUMENTS 124,261 A * 3/1872 Fowle ..... A47G 21/14 211/70.7
983,736 A * 2/1911 Maconochie ..... A47G 21/02 29/525
D48,937 S * 4/1916 Huthnnaker et al. ..... D7/641
1,452,418 A * 4/1923 Cunneen ..... A47L 19/04 211/41.3
1,886,075 A * 11/1932 Zorsch ..... A47G 21/14 211/70.7
2,011,910 A * 8/1935 Robbins ..... A47J 43/288 141/125
D154,856 S * 8/1949 Hvale ..... D7/637
D156,958 S * 1/1950 Hoeft ..... 206/564
D163,151 S * 5/1951 Wagner ..... D7/637
2,639,081 A * 5/1953 Metzger ..... B65D 5/504 206/488
2,651,927 A * 9/1953 Mullins ..... A47G 21/14 15/236.07
D244,340 S * 5/1977 Ashton ..... D7/641
4,515,332 A * 5/1985 Scharfy ..... A47G 21/14 211/70.6
4,834,328 A * 5/1989 Hall ..... A47G 21/14 248/174
D304,280 S * 10/1989 Leighton ..... D7/641
(Continued)

OTHER PUBLICATIONS https://www.amazon.ca/Otani-Stone-Small-3-1inch-Knife/dp/B01NCS6J8J; Jan. 4, 2017.*
(Continued)

*Primary Examiner* — Jennifer E. Novosad
(74) *Attorney, Agent, or Firm* — Law Office of Scott C Harris, Inc

(57) ABSTRACT

A cutlery holding system and method. Each of first, second and third pieces of cutlery are on a cutlery holder surface, each of the pieces of cutlery have an operative end that includes a food eating portion at a first end, and a handle portion culminating at a second end. The cutlery holder has a height which is effective to maintain a single tangent point between the bottom surface of each piece of cutlery and the top surface of the cutlery holder, and to keep the pieces spaced from one another.

19 Claims, 10 Drawing Sheets

(56) References Cited

U.S. PATENT DOCUMENTS 4,940,199 A * 7/1990 Hall ..... A47G 21/14 248/174
5,301,801 A * 4/1994 Sinn ..... A61B 17/06138 206/380
5,332,106 A * 7/1994 Schlotte ..... A47G 21/14 211/49.1
5,411,141 A * 5/1995 Bounds ..... A47G 21/14 206/553
D366,814 S * 2/1996 Stroecker ..... D7/641
D378,564 S * 3/1997 Hall ..... D7/637
D411,718 S * 6/1999 Davis ..... D7/637
D444,356 S * 7/2001 Conaway ..... D7/637
6,367,637 B1 * 4/2002 Davis ..... A61B 50/22 211/13.1
6,604,714 B1 * 8/2003 Hall ..... A47F 7/0035 206/232
D481,911 S * 11/2003 Yaskus ..... D7/641
6,994,304 B2 * 2/2006 Kim ..... A47G 21/14 248/174
D548,018 S * 8/2007 Ablo ..... D7/638
7,266,865 B1 * 9/2007 Rodin ..... A47G 21/14 24/3.12
7,290,661 B1 * 11/2007 DeFino ..... A47G 21/14 206/553
D573,417 S * 7/2008 Osbourn ..... D7/641
D578,832 S * 10/2008 Lloyd-Morris ..... D7/637
D579,278 S * 10/2008 Umnitz ..... D7/637
D617,609 S * 6/2010 Thomas ..... D7/601
D658,452 S * 5/2012 Elattrache ..... D7/637
D665,232 S * 8/2012 O'Connell ..... D7/637
D689,743 S * 9/2013 Tarantino ..... D7/637
D689,744 S * 9/2013 Tarantino ..... D19/86
D695,546 S * 12/2013 Kruger ..... D6/534
8,668,171 B2 * 3/2014 Tarantino ..... A47G 21/14 220/500
D710,656 S * 8/2014 Stewart ..... D7/637
D723,875 S * 3/2015 Elattrache ..... D7/637
D759,435 S * 6/2016 Schubert ..... D7/637
D779,893 S * 2/2017 deBretton Gordon ..... D7/637
D817,723 S * 5/2018 Elattrache ..... D7/638
10,111,542 B2 * 10/2018 Leung ..... A47G 21/145
2002/0014560 A1 * 2/2002 Diamond ..... A61M 5/008 248/37.3
2006/0265887 A1 * 11/2006 Malkewich ..... A45D 27/22 30/541
2009/0261049 A1 * 10/2009 McQuary ..... A47F 7/0028 211/70.7
2011/0253845 A1 * 10/2011 Bianco ..... A47G 21/14 248/37.3
2012/0298807 A1 * 11/2012 Rayko ..... A47G 21/14 248/37.3
2013/0087664 A1 * 4/2013 Weavel ..... A47G 21/14 248/37.3
2015/0157154 A1 * 6/2015 Rothenberg ..... A47G 21/14 248/37.3

OTHER PUBLICATIONS https://www.the-saleroom.com/en-gb/auction-catalogues/east-bristol-auctions/catalogue-id-sreas10038/lot-9cbcc79d-7683-404a-84a5-a42f011c69a8; Mar. 21, 2014.*

* cited by examiner

CUTLERY LIFTING AND SEPARATING DEVICE WITH CONTAMINATION PREVENTION

BACKGROUND

Cutlery, also called "cutlery" is commonly used by people to assist in eating their food. The cutlery comes into contact with the food and then the person's mouth. Hence it is important that the cutlery not be contaminated to avoid spread of disease.

Conventionally, cutlery is placed onto a table, or onto a napkin on the table, is used to touch the food, and also put into a mouth of the eater. During eating, the cutlery may be placed on the table. Any kind of contamination can hence travel to the cutlery from the table or any other surface, and to the user's mouth.

Single cutlery rests, such as "knife rests" are known for holding a single piece of cutlery. However, these have not conventionally done the job that is needed. Many of these rests are very short because they are only designed for a knife, and are not long enough to hold multiple utensils.

SUMMARY

Multiple different embodiments are described herein to carry out the function of holding multiple different utensils of cutlery and holding those pieces at a proper height and proper spacing to avoid cross contamination.

In one embodiment, the rests have a minimum height of ½ to ⅝" inch. In this embodiment, the rests are at the proper height for balancing between the purpose of elevating the cutlery for food safety and cross-contamination avoidance. The rests also maintain the cutlery elevated; while coming into contact with each piece of cutlery only at a tangent point between the rest and rear tangent spot on the cutlery, preferably only touching at an edge of the rest.

Embodiments describe multiple different materials that can be used as a rest for multiple different pieces of cutlery holding onto the cutlery pieces by their tangent portion, thus minimizing the possibility of contamination or cross-contamination.

An embodiment describes a device holding multiple utensils at least one half inch high, each of the utensils being held on the same device, and holding up the neck arch or head portion of the utensils at a tangent point between the utensils and an operative surface of the device.

An embodiment describes a rest that can hold up to 3 utensils. Another embodiment describes a rest that can hold up to 5 utensils.

DETAILED DESCRIPTION

Multiple different embodiments are described herein. These embodiments each have surfaces to interact with multiple different utensils of cutlery and hold those pieces at a proper height and proper spacing to avoid cross contamination.

In one embodiment, the rests have a height of at least ½ to ⅝ inch, and the material of the rest comes into contact with each piece of cutlery only at a tangent point between the rest and rear tangent spot on the cutlery, preferably only touching at an edge or single spot on the rest.

Embodiments describe multiple different materials that can be used as a rest for multiple different pieces of cutlery holding into the cutlery pieces by their tangent portion, thus minimizing the possibility of contamination or cross-contamination from any surface below it.

An embodiment describes a device holding multiple utensils at least ½ inch high, each of the utensils being held on different locations on the same surface of the same device, and holding the utensils at a tangent point between the utensils and an operative surface of the device.

An embodiment describes a rest that can hold up to 3 utensils. Another embodiment describes a rest that can hold up to 5 utensils.

The rest can be formed of that which can be in any shape, and almost any hard material. If a porous material is used, that porous material can be sealed, to minimize contamination in the pores.

In embodiments, the material of the rest can be made of one or more of metal, marble, wood, acrylic, melamine, hard polyester, glass, or ceramic. Other hard materials can also be used. The material can be formed in any shape as the rest; although the top portion of the material preferably has a surface which can hold to the tangent point of the cutlery.

Figure 1:
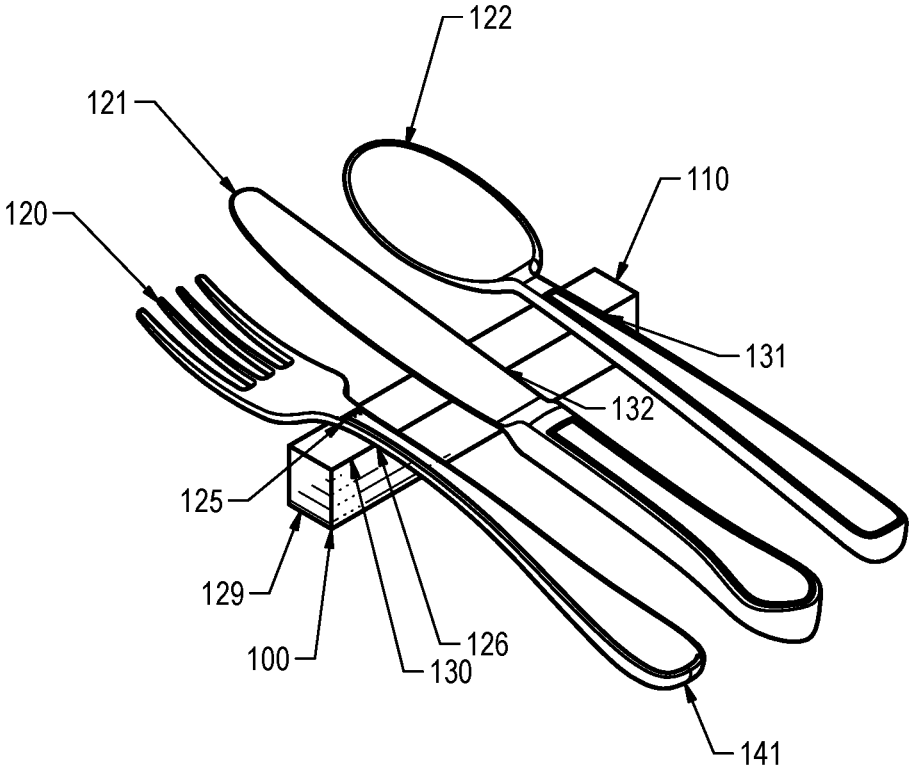
FIG. 1 shows a first embodiment from an upper perspective views.

Embodiments are described with reference to the accompanying figures. FIG. 1 shows a first embodiment, 100, showing the cutlery rest 110, along with 3 pieces of cutlery: a fork 120, a knife 121 and a spoon 122. Each of the cutlery pieces has an operative end that includes a food eating portion at a first end. That is the rounded part of the spoon, the tines of the fork, and the blade of the knife. Each also has a handle portion culminating at a second end.

Note that the neck portion 125 of the fork 120 sits on the flat upper surface 130 of the cutlery rest 110. As explained with reference to other drawings, a tangent portion 126 between the neck of the fork, and the upper surface 130 of the rest 110, forms the connection portion between the cutlery rests on the upper surface 130. Similarly, a tangent portion 131 between the neck of the spoon 122 and the upper surface holds the spoon. In a similar way, a tangent portion 132 exists between the knife and the rest 110.

Figure 2:
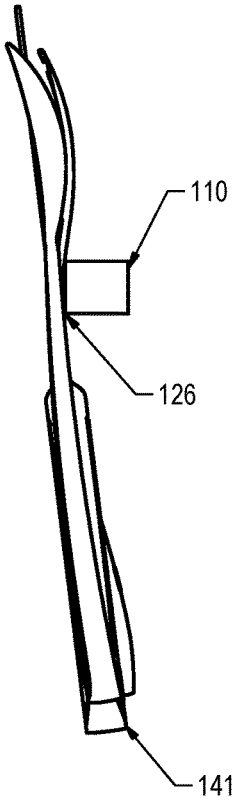
FIG. 2 shows a side view of the first embodiment.

These tangent portions are caused by the higher height of the spoon rest device. For example, the height of this device needs to be ½ inch tall from its bottom surface 129 to its top surface 130 and is preferably more like ⅝ inches tall. This causes an angle between the rear portion of the cutlery such as 141 and the front portion of the cutlery, thus causing a tangent portion to exist. FIG. 2 illustrates this tangent portion from the side, where it can be seen that there is a tangent portion 131 that exists between the rear end of the cutlery 141 actually change that 131 to 126 and where the cutlery sits on the cutlery stand 110.

Figure 3:
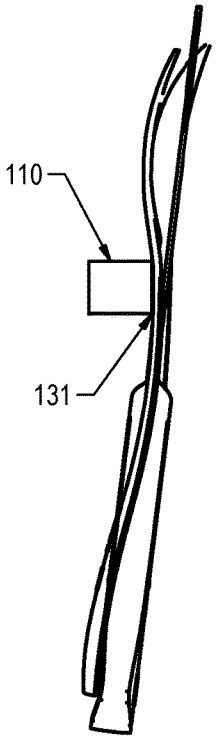
FIG. 3 shows the opposite side view of the first embodiment.

Each piece of cutlery may separately set at a different location on the stand. FIG. 3 shows the opposite side view, again showing the stand 110 and here showing the tangent 131 on which the material sets.

Figure 4:
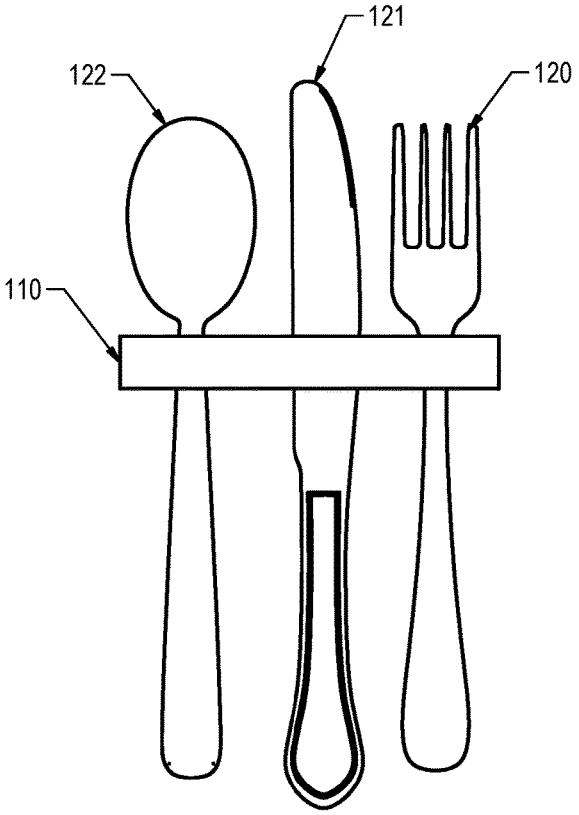
FIG. 4 shows a bottom view of the first embodiment.

FIG. 4 illustrates the view of the cutlery from the bottom, showing how the fork 120, knife 121 and spoon 122 can sit on the stand, such that the neck of these parts are touching the stand 110, and the portion of the parts that actually hold the food and come into contact with the user's mouth are spaced from those parts.

Figure 5:
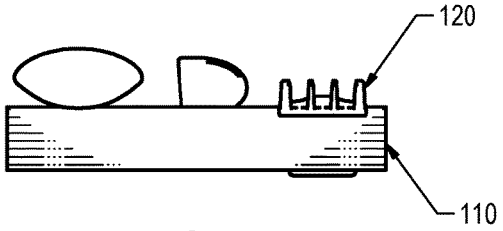
FIG. 5 shows a front on view of the first embodiment.

FIG. 5 illustrates the cutlery such as 120, sitting on the rest 110, again forming an angle between the end of the cutlery and the resting point of the cutlery such that the cutlery sits on a tangent point at the edge of the rest.

Figure 6:
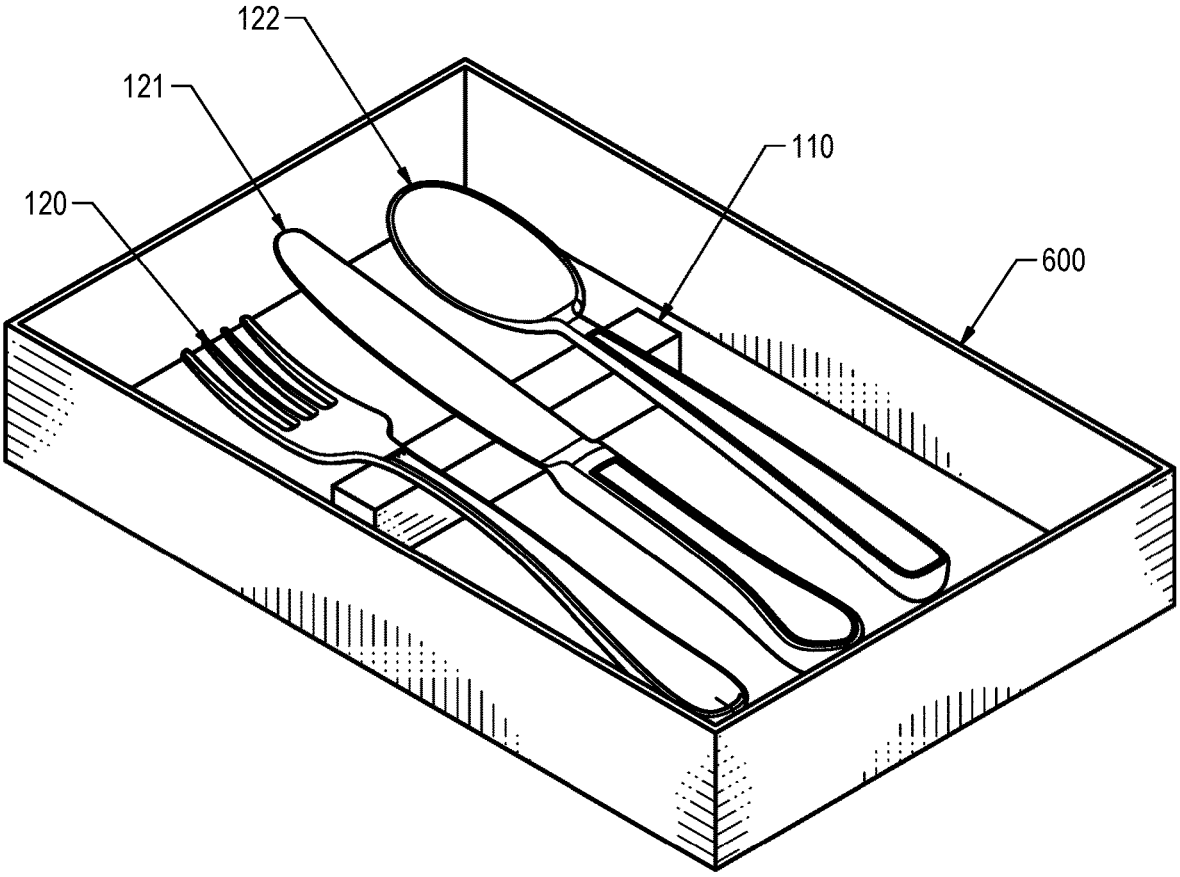
FIG. 6 shows the first embodiment packaged in a box.

FIG. 6 shows the spoon rest or the cutlery rest 110 packaged in a packaging box 600 along with the cutlery held in place including fork 120, knife 121 and spoon 122. By packaging in this way, the cutlery is held in place in the proper location on the rest 110, so that users can see the way in which the cutlery should be held on the rest 110 in use.

In one embodiment, there is clear shrinkwrap held over the cutlery to hold the cutlery in place on the stand on the rest 110.

Figure 7:
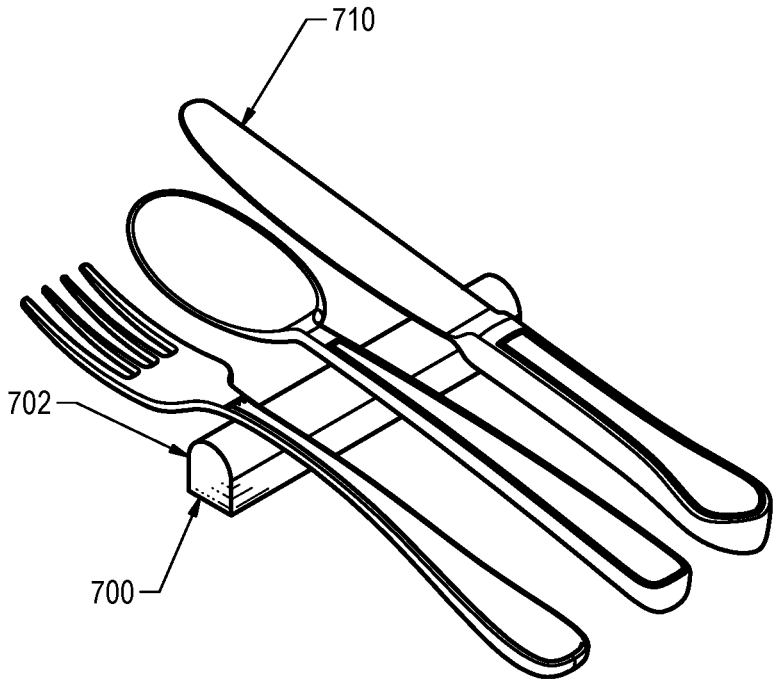
FIG. 7 shows a second embodiment.

According to embodiments, multiple different materials, shapes of materials and others can be used. FIG. 7 shows a second embodiment in which the rest material 700 is a piece of bullnose which is substantially rounded at its top section 702 in the location that touches against the cutlery 710. Again this forms a mechanical barrier to avoid cross-contamination.

Figure 8:
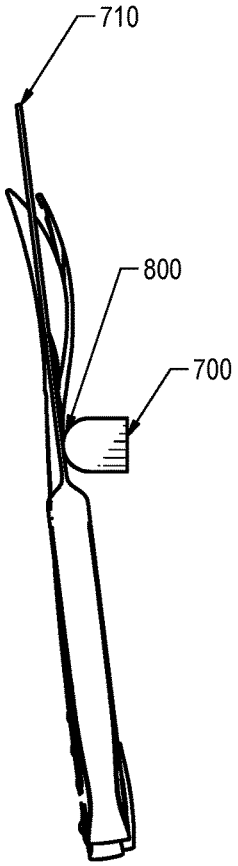
FIG. 8 shows a first side view of the second embodiment.

FIG. 8 illustrates side views of this embodiment, showing that there is a tangent point shown is 800 between the rest 700 and the cutlery 710. Each of the different pieces of cutlery has a different tangent point, but each of these are separated from and spaced from the location where the cutlery will touch food.

Figure 9:
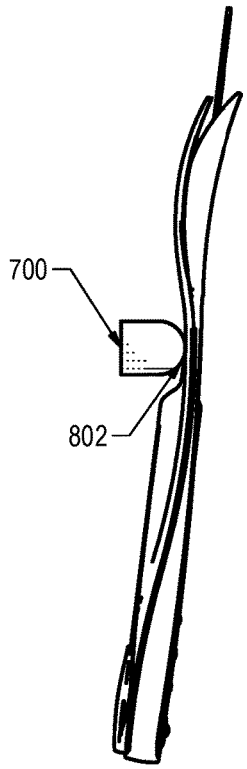
FIG. 9 shows the second side view of the second embodiment.

In a similar way, FIG. 9 shows this from the opposite side.

Figure 10:
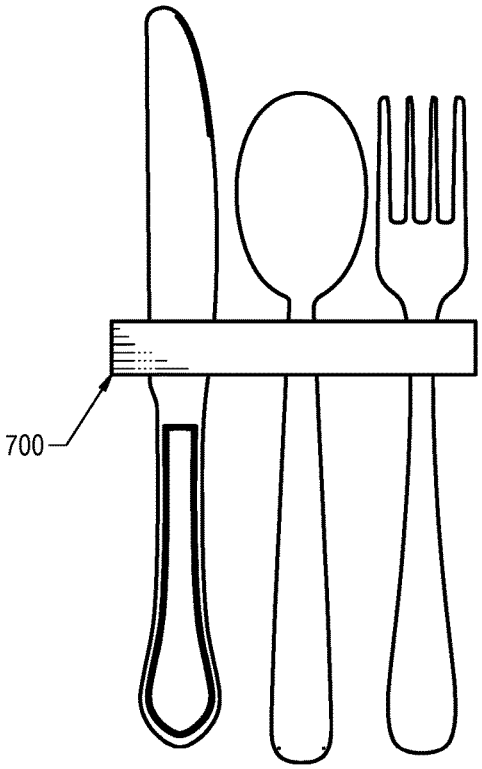
FIG. 10 shows a bottom view of the second embodiment.
Figure 11:
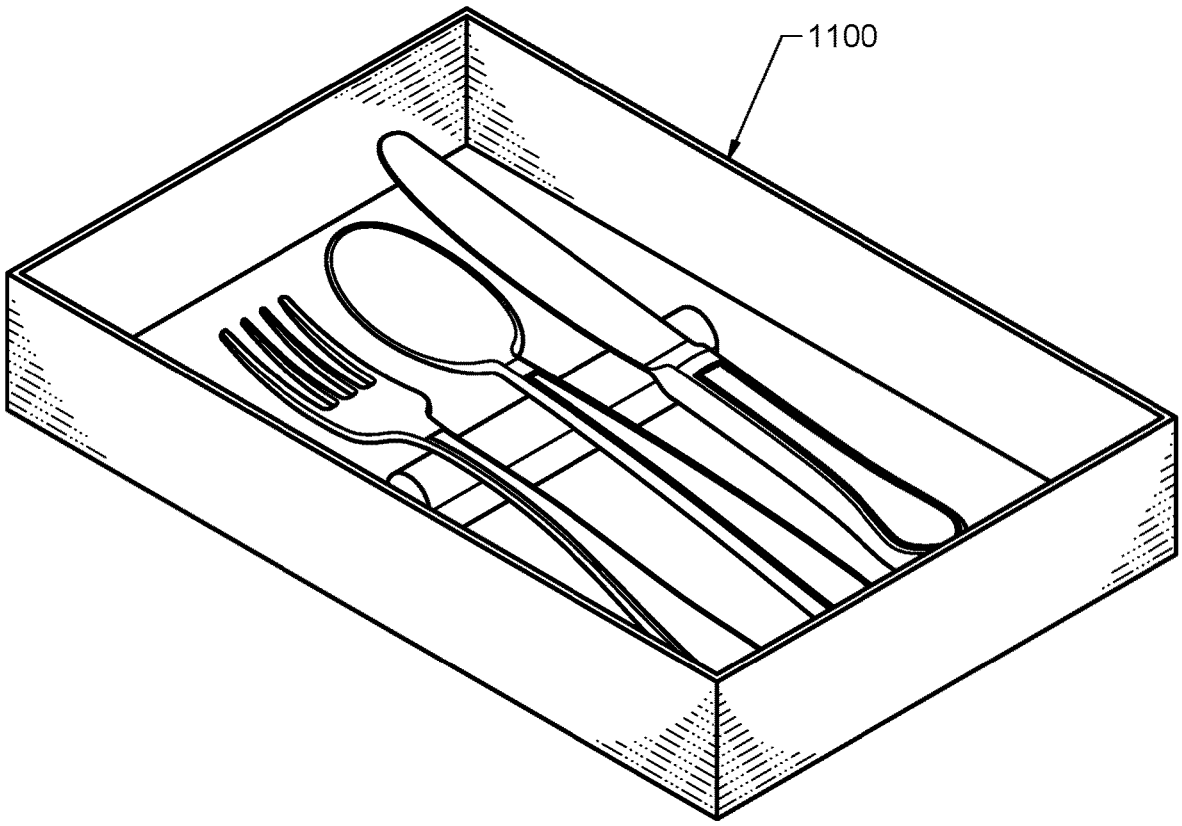
FIG. 11 shows the first or second embodiment in a box.

FIG. 10 shows a bottom view of the cutlery on the rest 700. Again, this can be sold packaged in a package shown as 1100 in FIG. 11, so that the user can see all of the cutlery on the rest in the package.

Figure 12:
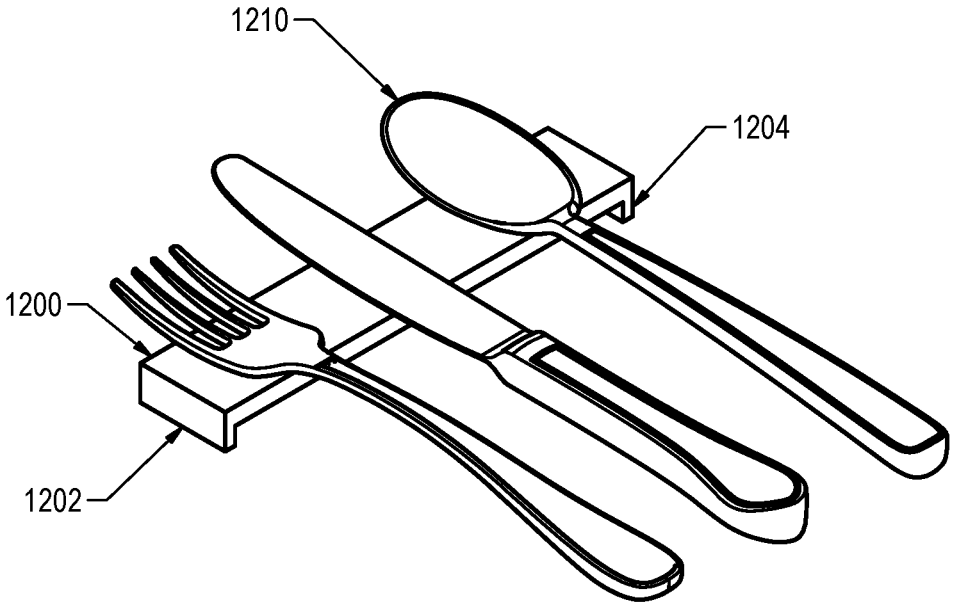
FIG. 12 shows a third embodiment.

FIG. 12 illustrates another embodiment where the rest 1200 is formed of a flattened elongated piece of material. In this embodiment, the material may have edge stilts 1202, 1204 to bring the height of the top of the piece of material to the proper height to cause connection between the tangent point of the material or cause the proper angle to cause the cutlery to touch the tangent point for tangent point.

Figure 13:
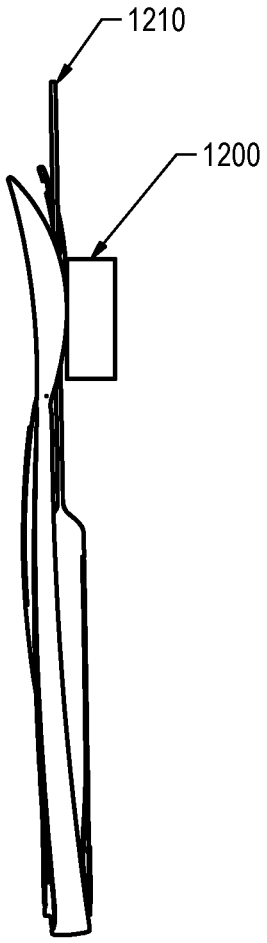
FIG. 13 shows a first side view of the third embodiment.
Figure 14:
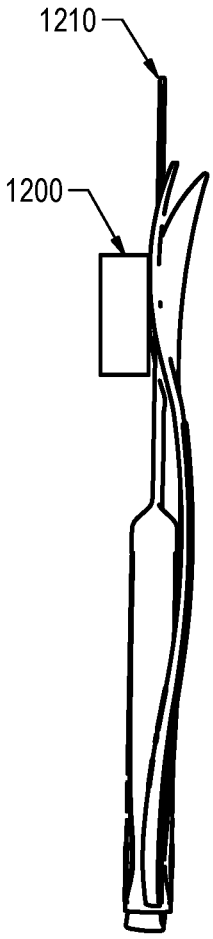
FIG. 14 shows a second side view of the third embodiment.

FIGS. 13 and 14 respectively the side views showing the cutlery touching this tangent point.

Figure 15:
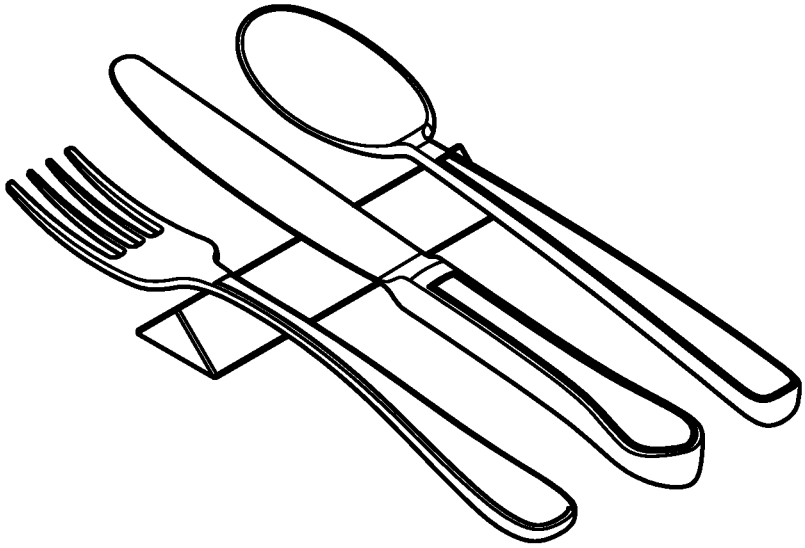
FIG. 15 shows a triangular embodiment.
Figure 16:
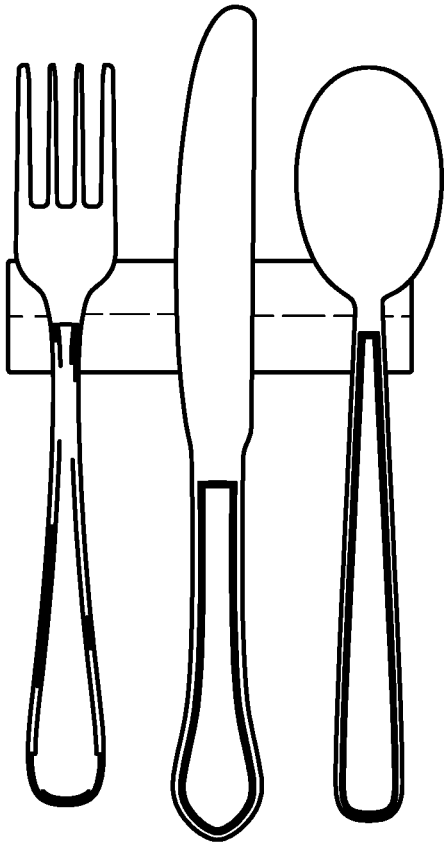
FIG. 16 shows a top view of the triangular embodiment.

FIG. 15 shows a triangular embodiment, and FIG. 16 shows a top view of the triangular embodiment.

Other materials can also be used. The materials can be any hard material as described herein. In one embodiment, the material is hardened against shattering so that it will not break easily. Other embodiments can use non-porous materials, such as glass and other crystalline material. In one embodiment, the material can be formed of an elastomeric material, such as rubber.

In other embodiments, there can be indentations in the top surface, at locations to enable spacing the cutlery pieces from one another, to force a separation between those pieces. The materials can also be natural materials such as bamboo or other plant materials.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A cutlery holding system, comprising:

first, second and third pieces of cutlery each having an operative end that includes a food eating portion at a first end, and a handle portion culminating at a second end; a cutlery holder, having a bottom surface and a top surface, the bottom surface facing in an opposite direction from the top surface, and the top surface adapted for holding a bottom surface of the cutlery, and the cutlery holder having a length extending between a first side and a second side effective to enable all of the first, second, and third pieces of cutlery to be held on the top surface, with spaces between the first, second, and third, pieces of cutlery when held on the top surface, the cutlery holder having a first edge stilt on the first side of the cutlery holder, extending at a right angle from the top surface to a supporting surface and the first edge stilt operative to hold the first side of the cutlery holder above the supporting surface by a distance based on a length of the first edge stilt, the cutlery holder having a second edge stilt on the second side of the cutlery holder, extending at a right angle from the top surface to the supporting surface, and the second edge stilt operative to hold the second side of the cutlery holder above the supporting surface by a distance based on a length of the second edge stilt, the first edge stilt and the second edge stilt each being longer than a thickness between the bottom surface and the top surface, the bottom surface of the cutlery holder held above and spaced from the supporting surface when the the first edge stilt and the second edge stilt are each pressed against the supporting surface, leaving an open area between the bottom surface and the supporting surface at areas other than the first edge stilt and the second edge stilt, and where that open area is at least along the length where the cutlery is held, and a distance between the top surface and the bottom surface of the first edge stilt and the second edge stilt of the cutlery holder being an amount effective to maintain an angle between the handle portion of each of said first, second and third pieces of cutlery, and the top surface of the cutlery holder to maintain a single tangent point between the bottom surface of the cutlery of each of said first, second and third pieces of cutlery and the top surface of the cutlery holder and no points of contact between the bottom surface of the cutlery of each of said first, second and third pieces of cutlery and the top surface of the cutlery holder other than said single tangent point.

2. The system as in claim 1, wherein the amount effective to maintain an angle between the handle portion of each of said first, second and third pieces of cutlery, and the top surface of the cutlery holder is at least one half inch in height.

3. The system as in claim 1, wherein the amount effective to maintain an angle between the handle portion of each of said first, second and third pieces of cutlery, and the top surface of the cutlery holder is at least ⅝ inches in height.

4. The system as in claim 1, wherein the first, second and third pieces of cutlery are respectively a knife, fork and spoon.

5. The system as in claim 1, further comprising a fourth and fifth piece of cutlery which are from the group consisting of an extra spoon, knife and fork, and where the cutlery holder having a length effective to enable all of the first, second, third, fourth and fifth pieces of cutlery to be held on the top surface.

6. The system as in claim 1, wherein the cutlery holder is formed of a porous material that has its pores sealed.

7. The system as in claim 1, wherein the top surface of the cutlery holder is substantially flat, and the tangent points are formed at edge portions of the substantially flat cutlery holder.

8. The system as in claim 1, wherein the top surface of the cutlery holder is one of a rounded, triangular, and squared material where the tangent points are formed at a single point on the shape.

9. The system as in claim 1, wherein the bottom surface of the cutlery holder is flat at locations other than the first edge stilt and the second edge stilt.

10. The system as in claim 1, wherein the bottom surface of the cutlery holder is uneven.

11. The system as in claim 1, wherein the top surface of the cutlery holder is rounded, and the tangent point is formed at a portion of the rounded surface which extends furthest away from the bottom surface.

12. A method of holding cutlery on a cutlery holder, comprising:

providing a cutlery holder; resting each of first, second, and third pieces of cutlery on a cutlery holder surface of the cutlery holder, each of the pieces of cutlery having an operative end that includes a food eating portion at a first end, and a handle portion culminating at a second end; wherein the cutlery holder having a bottom surface and a top surface, the bottom surface facing in an opposite direction from the top surface, and the top surface adapted for holding a bottom surface of the cutlery, raising a bottom surface of the cutlery holder using a first edge stilt on the first side of the cutlery holder, extending at a right angle from the top surface to a supporting surface, and also using a second edge stilt on the second side of the cutlery holder, extending at a right angle from the top surface to the supporting surface, where the first edge stilt and the second edge stilt each being longer than a thickness between the bottom surface and the top surface, to raise the bottom surface away from the cutlery holder, the bottom surface of the cutlery holder held above and spaced from the supporting surface when the the first edge stilt and the second edge stilt are each pressed against the supporting surface, leaving an open area between the bottom surface and the supporting surface at areas other than the first edge stilt and the second edge stilt, and where that open area is at least along the length where the cutlery is held, where the cutlery holder having a length effective to enable all of the first, second, and third pieces of cutlery to be held on the top surface, with spaces between the first, second, and third, pieces of cutlery when held on the top surface, and using a distance between the first edge stilt and the second edge stilt of the cutlery holder and the top surface to maintain an angle between the handle portion of each of said first, second and third pieces of cutlery, and to maintain a single tangent point on each piece of cutlery between the bottom surface of the cutlery of each of said first, second and third pieces of cutlery and the top surface of the cutlery holder and no points of contact between the bottom surface of the cutlery of each of said first, second and third pieces of cutlery and the top surface of the cutlery holder other than said single tangent point; and where the resting comprises resting the cutlery on the top surface with each of the first, second, third, pieces of cutlery spaced from one another on the top surface, and each of the first, second, third, pieces of cutlery having a single tangent point between the bottom surface of the cutlery and the top surface of the cutlery holder and with the open area between the bottom surface and the supporting surface at areas other than the first edge stilt and the second edge stilt.

13. The method as in claim 12, wherein the amount being effective to maintain an angle between the handle portion of each of said first, second and third pieces of cutlery, and the top surface of the cutlery holder is at least one half inch in height.

14. The method as in claim 12, wherein the amount being effective to maintain an angle between the handle portion of each of said first, second and third pieces of cutlery, and the top surface of the cutlery holder is at least ⅝ inches in height.

15. The method as in claim 12, wherein the first, second, and third pieces of cutlery are respectively a knife, fork, and spoon.

16. The method as in claim 12, wherein the cutlery holder is formed of a porous material with sealed pores.

17. The method as in claim 12, wherein a top surface of the cutlery holder is substantially flat, and the tangent points are formed at edge portions of the substantially flat cutlery holder.

18. The method as in claim 12, wherein the top surface of the cutlery holder is one of a rounded, triangular, and squared, material where the tangent points are formed at a single point on the shape.

19. The method as in claim 12, wherein the top surface of the cutlery holder is rounded, and the tangent point is formed at a portion of the rounded surface which extends furthest away from the bottom surface.

* * * * *